US010062971B2

(12) United States Patent
Mössinger et al.

(10) Patent No.: US 10,062,971 B2
(45) Date of Patent: Aug. 28, 2018

(54) POWER DIVIDER

(71) Applicant: Lisa Draexlmaier GmbH, Vilsbiburg (DE)

(72) Inventors: Alexander Mössinger, Tübingen (DE); Waldemar Ott, Steinenbronn (DE); Daniel Geier, Kircheim (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 134 days.

(21) Appl. No.: 14/946,833

(22) Filed: Nov. 20, 2015

(65) Prior Publication Data

US 2016/0149282 A1 May 26, 2016

(30) Foreign Application Priority Data

Nov. 21, 2014 (DE) ..... 10 2014 117 077

(51) Int. Cl.
*H01Q 21/00* (2006.01)
*H01P 5/20* (2006.01)

(52) U.S. Cl.
CPC ..... *H01Q 21/0006* (2013.01); *H01P 5/20* (2013.01)

(58) Field of Classification Search
CPC ..... H01Q 21/0006; H01Q 21/0037; H01Q 21/0043; H01Q 21/005; H01Q 21/0062; H01Q 21/0075; H01Q 21/0081
See application file for complete search history.

(56) References Cited

U.S. PATENT DOCUMENTS 4,365,215 A 12/1982 Landry
4,758,843 A * 7/1988 Agrawal ..... F16K 17/24 343/700 MS
4,849,720 A * 7/1989 Call ..... H01P 1/161 333/125
9,343,795 B1 * 5/2016 Halligan ..... H01P 5/16
2012/0077504 A1 * 3/2012 Schadler ..... H01Q 1/246 455/446

FOREIGN PATENT DOCUMENTS

WO WO 99/34477 7/1999

OTHER PUBLICATIONS

Hee-Ran Ahn and Ingo Wolff, "General Design Equations, Small-Sized Impedance Transformers, and their Application to Small-Sized Three-Port 3-dB Power Dividers," IEEE Transactions on Microwave Theory and Techniques, vol. 49, No. 7, pp. 1277-1288, Jul. 2001.

* cited by examiner

*Primary Examiner* — Jessica Han
*Assistant Examiner* — Patrick Holecek
(74) *Attorney, Agent, or Firm* — Finnegan, Henderson, Farabow, Garrett & Dunner LLP

(57) ABSTRACT

A power divider may include a signal conductor. The signal conductor may include an input, a first conductor section with a first width and a first output, and a second conductor section with a second width and a second output. The first and second widths may be different. The signal conductor may also include a septum. The septum may extend into the signal conductor from a side of the signal conductor opposite the input.

20 Claims, 5 Drawing Sheets

POWER DIVIDER

CROSS REFERENCE TO RELATED APPLICATION

This application is based upon and claims the benefit of prior German Patent Application No. 10 2014 117 077.6, filed on Nov. 21, 2014, the entire contents of which are incorporated herein by reference

TECHNICAL FIELD

The present disclosure relates to a power divider, such as a power divider for high-frequency applications. The power divider may include one input and two outputs, and frequency-dependent division ratios.

BACKGROUND

Antennas in satellite-communication may include a maximum regulatory compliant equivalent isotropic radiated power spectral density (EIRP-SD) in a transmitting frequency band of the antenna. This may be achieved by an amplitude distribution in an aperture plane of the antenna. In array antennas, aperture illumination may be implemented by a power divider network, which may excite the single radiating elements of the antenna array. Inputs and outputs of a power divider may be designed such that an asymmetrical power distribution creates conditions for desired aperture illumination.

A homogeneous aperture illumination may be desirable for receiving characteristics of the array antenna, because homogeneous aperture illumination may maximize antenna gain. If a shared power divider network is used for the transmitting band and the receiving band, however, this may result in a reduced performance capability of the array antenna in the reception case due to an inhomogeneous power divider network used in the transmitting frequency band.

WO 99/34477 describes a power divider where impedance matching, and consequently, power division, may be optimized by way of the location and size of constrictions. U.S. Pat. No. 4,365,215 and Hee-Ran Ahn; Wolff, I., "General design equations, small-sized impedance transformers, and their application to small-sized three-port 3-dB power dividers", Microwave Theory and Techniques, Transactions on, Vol. 49, No. 7, pages 1277 to 1288, July 2001, describe design suggestions for power dividers.

SUMMARY

Embodiments of the present disclosure provide a power divider and an antenna which enables desired aperture illuminations by way of a frequency-dependent power division.

For high-frequency signals, the power divider may include a signal conductor having one input and two outputs. An imaginary center line of the input may separate signal conductor sections of the first and second outputs, wherein the signal conductor sections of the first and second outputs may have differing impedances. A septum may additionally be introduced. The septum may be a recess or a wall, for example. The septum may extend from the side of the signal conductor located opposite the input partially into the signal conductor and may be arranged offset in relation to the center line.

The effects of an asymmetrical design of the outputs and of the septum may thereby be combined. Depending on conduction technology used to implement the power divider, stronger effects in the low frequency range and stronger effects in the higher frequency range may be produced. By combining effects, it is possible to design a divider that, for example, may have a considerably higher illumination in the transmitting frequency band than in the receiving band.

The power divider may be connected by the input to a transceiver device and by the outputs to antenna elements, so that the antenna elements can be operated with differing illuminations in the transmitting and receiving frequency bands.

The outputs may have a shared second axis of symmetry, where the shared second axis may have differing impedances. In large antenna arrays, for example, it is therefore possible to better interconnect the individual power dividers in a network at equally long paths between power dividers.

Power dividers according to embodiments of the present disclosure are suitable for different conducting technologies. If the signal conductor is a waveguide, the losses can be minimized even if a larger installation space is required. In the case of a ridge waveguide, for example, the available bandwidth may be increased. If a neutral conductor, such as a microstrip, coaxial line or a rectax, is used as the signal conductor, then broadband, compact power dividers can be implemented. A microstrip may be cost-effective to produce. A rectax may be a very low-loss rectangular coaxial line, which may contain a dielectric.

To compensate for the effects of differing impedances of outputs, the septum may be shifted to, or located nearer to, the output having the greater impedance.

The impedance ratio of the two outputs may be in a range of 1 to 1.1 (1:1.1) to 1:1.7. For a rectax or a ridge waveguide, for example, the impedance ratio of the two outputs may be in a range of 1:1.3 to 1:1.5. This ratio may allow asymmetry to be compensated for by the septum in the reception case, but may also make variable divider ratios possible in the transmission case. In larger array antennas, for example, very large differences in the illumination of individual antenna elements may be possible via the arrangements of multiple power dividers connected downstream in a tree structure.

The septum may have a length extending into the signal conductor of no more than half a wavelength, wherein the wavelength may correspond to a maximum wavelength of a signal frequency range of the antenna.

Moreover, the septum may have a width of no more than one third the wavelength, for example of the waveguide, or 0.8 of a width of the input, for example a microstrip. The septum may operate reliably in this range.

The offset may influence setting the divider ratio. The septum may be offset by no more than one quarter wavelength from the center line.

The described embodiments may be effective when the receiving frequency band and transmitting frequency band are in bands that are separated as much as possible from each other. For a homogeneous receiving aperture and an inhomogeneous transmitting aperture in satellite communication, for example, the divider ratio may be set such that the divider ratio of the power of the outputs in the receiving frequency band may be smaller than the divider ratio of the power of the outputs in the transmitting frequency band. Divider ratios may be 1:1 in the receiving frequency band, and between 1:1.1 and 1:10 in the transmitting frequency band. For example, divider ratios may be between 1:1 to 1:4 in the transmitting frequency band.

The power divider may be suitable for receiving and transmitting frequency bands in the Ka band or Ku band, where there may be a large difference between the bands for receiving and transmitting.

The antenna according to embodiments of the present disclosure may use the aforementioned power dividers to connect a plurality of antenna elements to a transceiver device, wherein the difference in the power between the respective outputs in the transmitting frequency band may differ for two neighboring power dividers, and may provide high variability in setting a desired aperture illumination.

The properties, features and advantages of the present disclosure, and the manner in which these are achieved, will become more apparent and clearly understandable in connection with the following description of exemplary embodiments, which will be described in more detail in connection with the drawings. For the sake of clarity, identical or like acting elements may be denoted by the same reference numerals.

DETAILED DESCRIPTION

Figure 1:
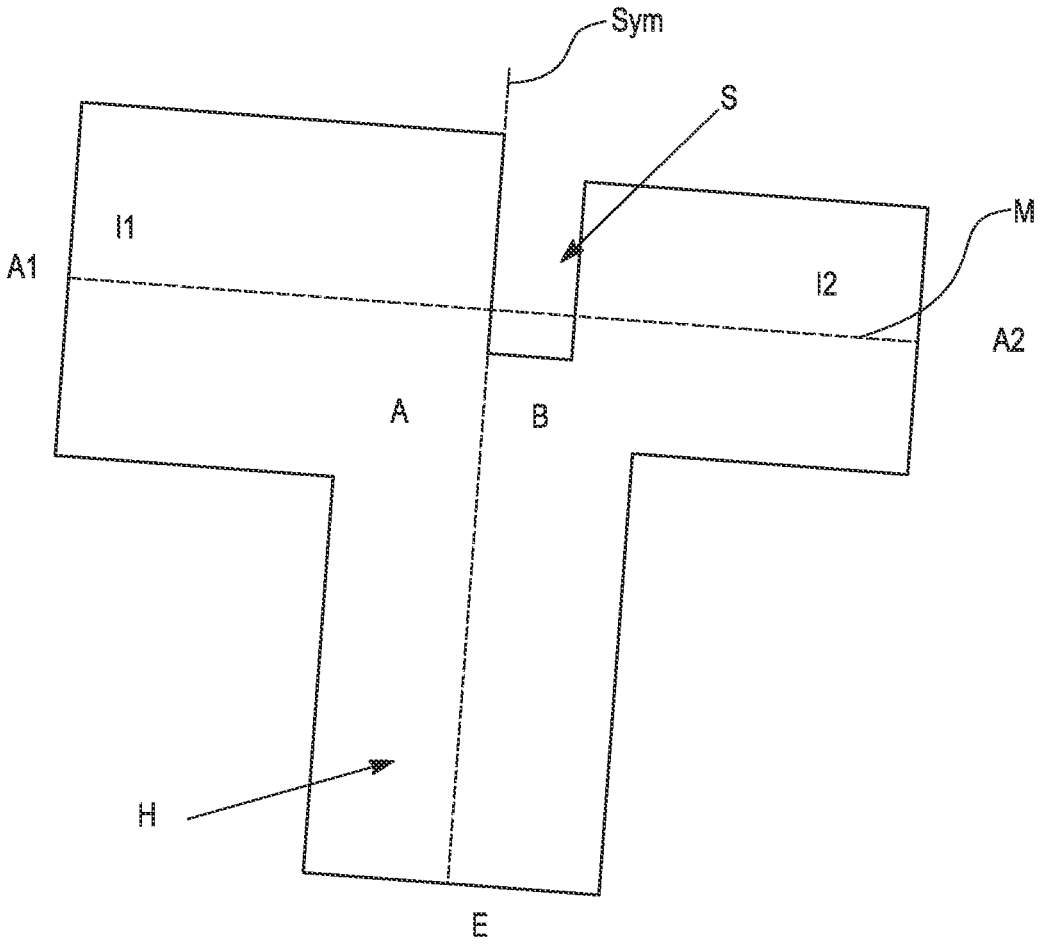
FIG. 1 shows a power divider according to the present disclosure.

A power divider according to the present disclosure is shown in FIG. 1, having one input E and two outputs A1, A2. The power divider may divide the signals received by the input E among the two outputs A1, A2, or combine the signals received by the outputs A1, A2 for the input E.

An imaginary center line Sym divides the signal conductor H into two signal conductor sections A and B, wherein the signal conductor sections A and B outcouple power components into the outputs A1 or A2. This power divider furthermore includes a septum S, which projects into the signal conductor H on the side located opposite the input E. The septum S may be offset slightly with respect to the center line Sym in the direction of an output A2.

The outputs A1 and A2 may be located on a second shared center line M; however they may differ from each other as they may have differing effective widths, resulting in differing impedances of these outputs A1 and A2. Said impedances are labeled in FIG. 1 as 11 and 12. The signal conductor H may be a waveguide in this exemplary embodiment. In the power divider according to FIG. 1, the left output A1 has a greater effective width, and therefore has a low impedance 11, and without taking the septum into consideration, couples out a lower power than the right output A2.

Figure 2:
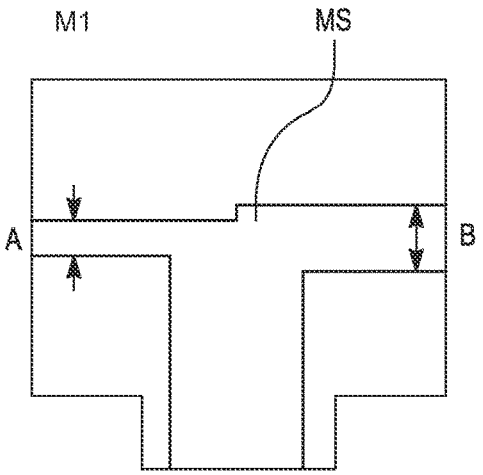
FIGS. 2 and 3 show asymmetrical power dividers in neutral conductor or waveguide technology.

The following figures each separately show neutral conductor technology MS such as microstrip, coaxial line, or rectax, for example, and waveguide technology HL. FIG. 2 shows the power divider for a signal conductor MS in microstrip technology, wherein the left signal conductor section A is narrower than the right signal conductor section B, and whereby the right signal conductor section B may couple out a greater power.

Figure 3:
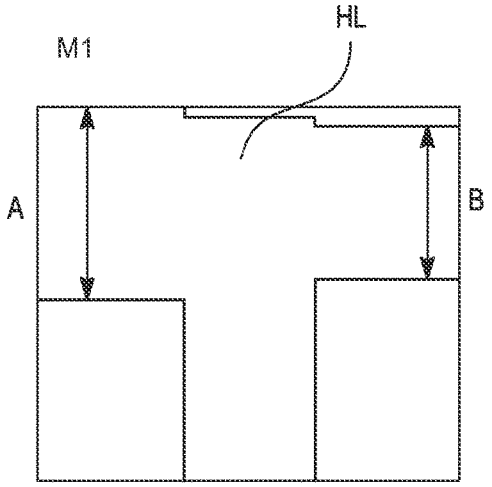

The situation is reversed in the signal conductor according to FIG. 3, which is configured as a waveguide HL. Here, the larger effective width of the left signal conductor section A may result in lower power outcoupling than the narrower right signal conductor section B.

As shown, the impedances of the signal conductor sections A and B are different in the two variants, creating an asymmetrical power divider mechanism M1. This power division is frequency-dependent, as described below and shown in FIG. 6.

Figure 4:
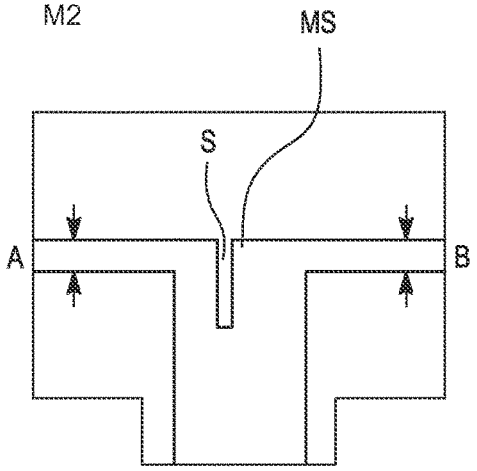
FIGS. 4 and 5 show power dividers including a septum in neutral conductor or waveguide technology.
Figure 5:
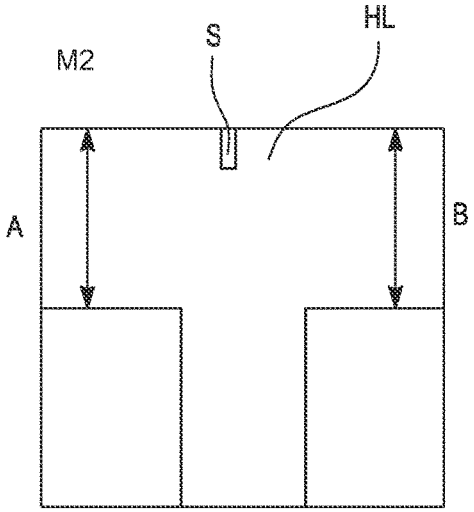

FIGS. 4 and 5 show a second mechanism M2, which is again a frequency-dependent power division that results in asymmetry in the power division. The power division is described below and shown in FIG. 6. A septum S is introduced into the microstrip MS or waveguide HL. In the microstrip, the septum S may be a recess in a conducting layer that is applied to a dielectric of the signal conductor MS. In the waveguide HL according to FIG. 5, the septum S may be a surrounding wall projecting into the signal conductor HL. In both FIGS. 4 and 5, the septum S may be arranged with a slight offset to the left of the center line Sym, whereby the outcoupled power may be greater for the right signal conductor section B than for the left signal conductor section A.

Figure 6:
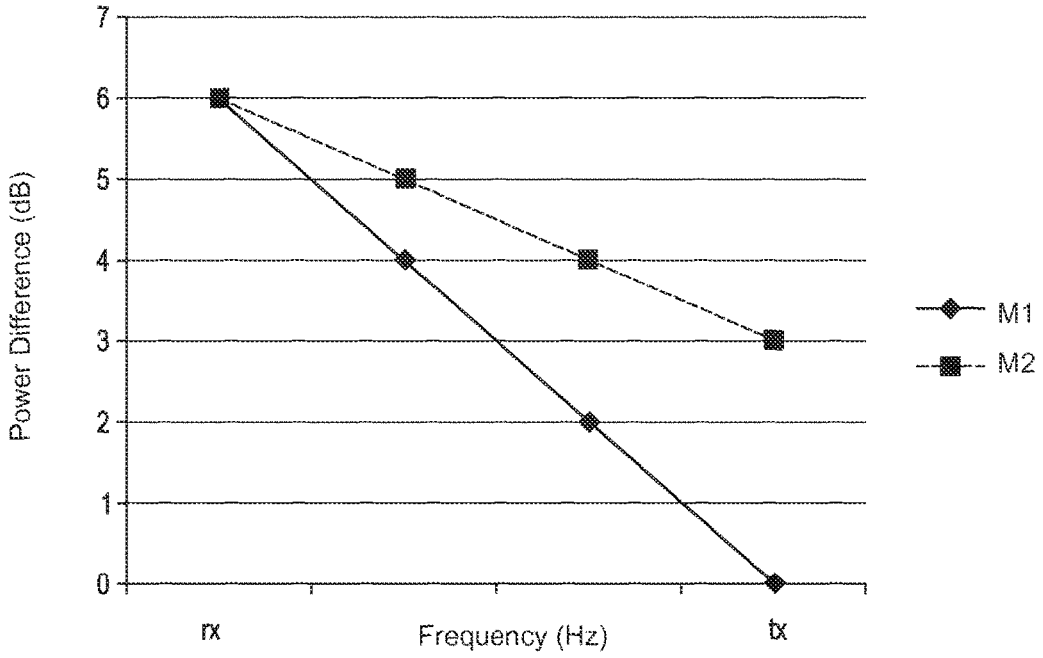
FIG. 6 schematically shows the frequency-dependent power division for power dividers having asymmetry (M1) and a septum (M2)

The two mechanisms M1 and M2 shown in FIGS. 2 to 5, which in FIGS. 2 and 3 are an asymmetry as a result of differing impedances of the outputs, and in FIGS. 4 and 5 are a septum S that is shifted toward the center line, can implement the same divider ratio at a certain frequency point, but may have differing frequency responses as shown in FIG. 6.

The mechanisms M1 and M2 are shown in FIG. 6. The horizontal axis represents frequency in hertz (Hz), while the vertical axis represents power in decibels (dB). At one frequency point, which is located in a receiving frequency band rx, the power dividers according to the two mechanisms M1 and M2 have the same divider ratio and the same power, while the divider ratios of the two mechanisms differ clearly at a second frequency point, which is in the transmitting frequency band tx; as shown by FIG. 6, the power difference for M1 may be 3 dB at transmitting frequency band tx, for M2, for example.

Figure 7:
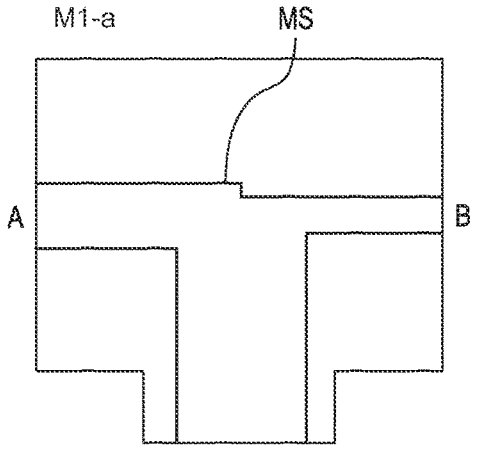
FIGS. 7 and 8 show power dividers having outputs that are mirrored in comparison with FIGS. 2 and 3.
Figure 8:
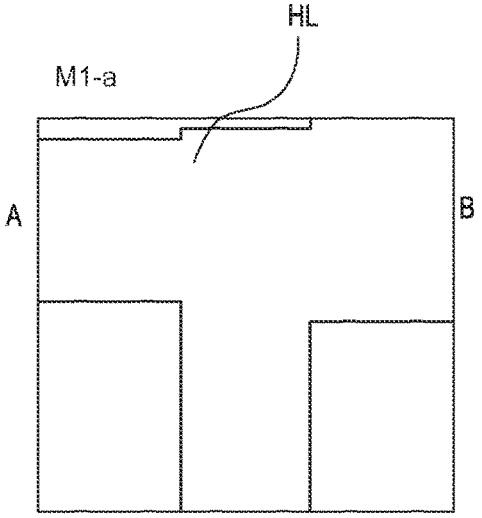

The power dividers according to FIGS. 2 and 3 may be mirrored on the center line Sym to create the power dividers according to FIGS. 7 and 8. The signal conductor may be a microstrip MS shown in FIG. 7, or a waveguide HL shown in FIG. 8. The mechanism produced is mechanism M1-*a*.

Figure 9:
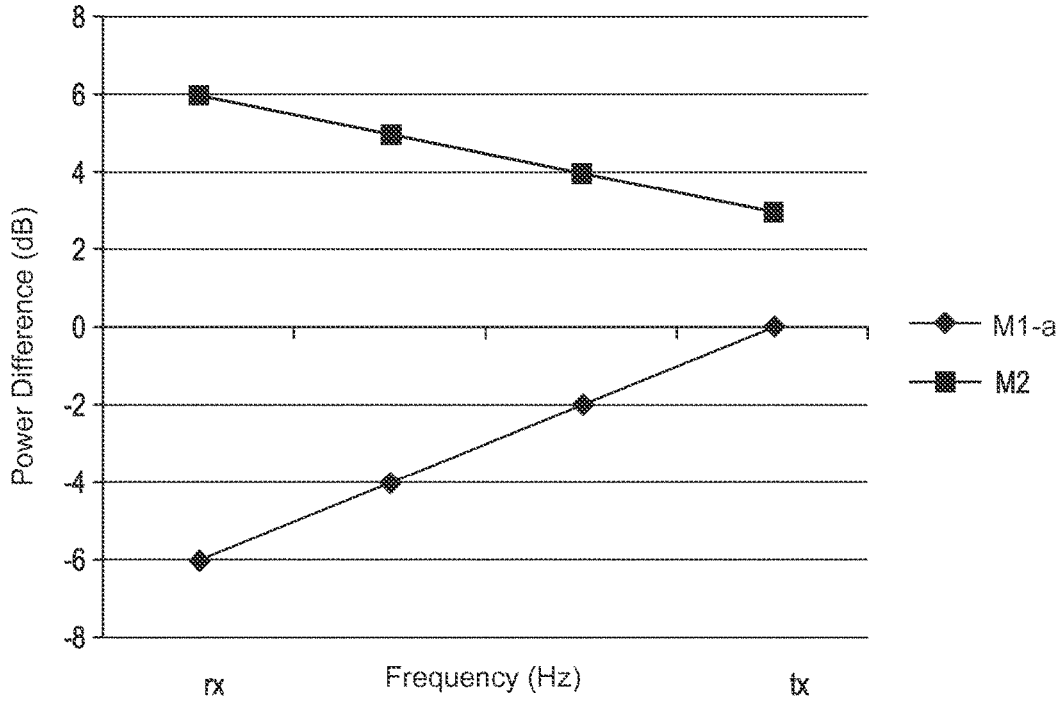
FIG. 9 shows the schematic frequency-dependent power division for the power dividers comprising a septum according to FIGS. 4 and 5, and having mirrored asymmetrical outputs according to FIGS. 7 and 8.

The left signal conductor section A may have a higher outcoupled power than the right signal conductor section B. This may result in a diagram according to FIG. 9, wherein the difference in power according to mechanism M1-*a* (asymmetry of the outputs) and according to mechanism M2

(septum) decreases from the receiving frequency band rx to the transmitting frequency band tx, however with the reverse sign.

Figure 10:
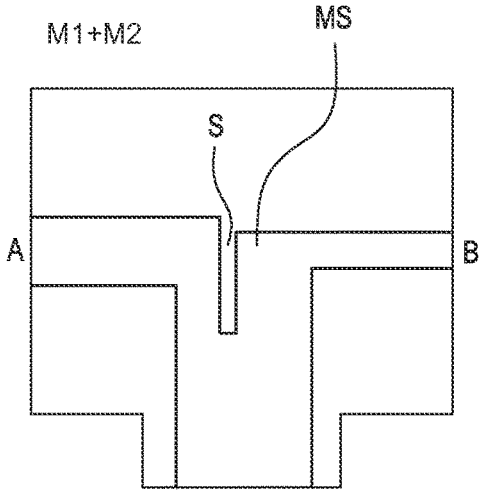
FIGS. 10 and 11 show power dividers according to the present disclosure having a septum and asymmetrical outputs in neutral conductor or waveguide technology.
Figure 11:
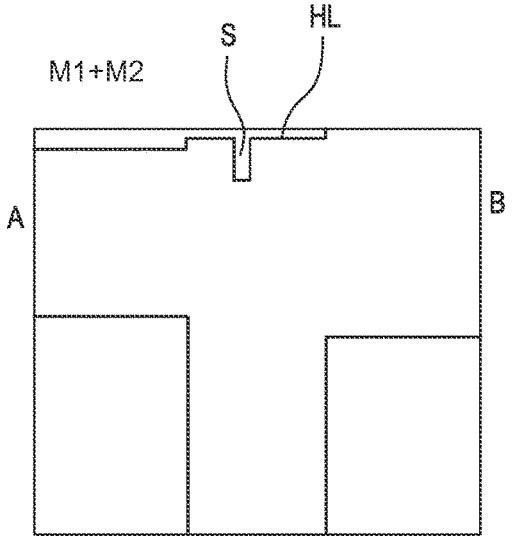

If effects of the two mechanisms M1 and M2 are combined in a common geometry, the two effects may superimpose each other. This is shown in FIGS. 10 and 11. The power dividers according to the present disclosure comprising microstrip technology MS and waveguide technology HL show asymmetrical signal conductor sections A and B, and additionally a septum S. In the case of the microstrip MS according to FIG. 10, the septum S may have variably high limitations by the conductor on both sides, while in the case of the waveguide HL according to FIG. 11, the septum S may have a uniform limitation on both sides with respect to the length thereof. In FIG. 11, a jump in the width of signal conductor sections A and B from the septum S to the respective output takes place spaced from the septum S. The jump in width for impedance matching may be used with both technologies M1 and M2 (including subtechnology M1-*a*), whereby easier modeling is achieved. The jump in width may occur for both outputs at the same distance from the center line Sym. If the jump in width is already present in the septum S, such as in FIG. 10, this may yield a more compact design.

Figure 12:
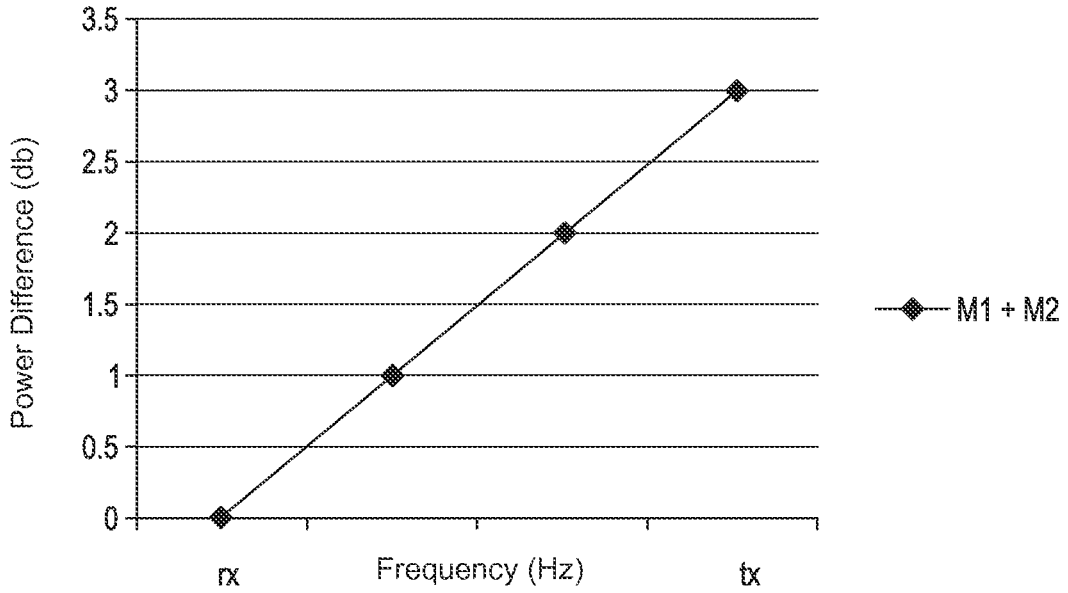
FIG. 12 shows the frequency-dependent power division of the power dividers according to FIGS. 10 and 11.

For both power dividers according to FIGS. 10 and 11, this results in the diagram according to FIG. 12, where the power is symmetrically distributed to both outputs in the receiving frequency band rx, while it is distributed asymmetrically in the transmitting frequency band tx with a difference in power of 3 dB.

Thus, frequency-dependent power dividers can be implemented. The power dividers may have a distinctive power division between the transmission case and the reception case in receiving frequency bands rx and transmitting frequency bands tx located in different frequency bands. The power divider may be symmetrical in the receiving frequency band rx, and may be asymmetrical in the transmitting frequency band tx.

Figure 13:
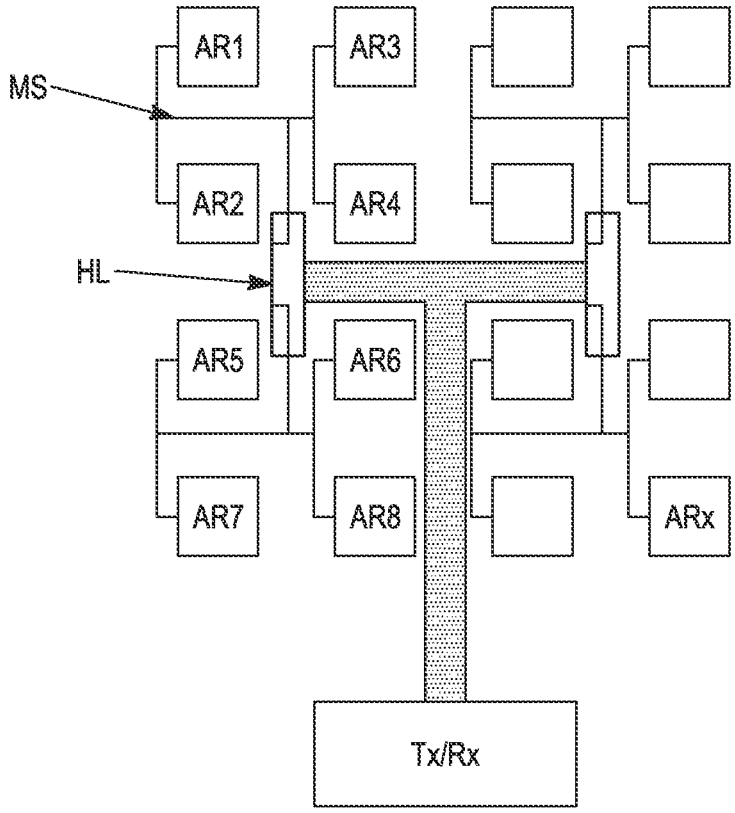
FIG. 13 shows an array antenna comprising a plurality of antenna elements and having a power division using multiple power dividers according to the present disclosure.

Array antennas can be dimensioned consistent with the frequency-dependent power dividers of the present disclosure. In FIG. 13, a transceiver device Tx/Rx is connected via a waveguide HL and microstrip MS network to antenna elements AR1, AR2, . . . , ARx. This network may include multiple power dividers, both in waveguide technology HL and in microstrip technology MS. In the case of symmetrical power division in the receiving frequency band, a desired aperture illumination can be set for the array antenna in the transmission case in keeping with the dimensioning of the power dividers and the connection of the same to the antenna elements AR1 . . . ARx.

A high variance may be set for the asymmetry of the power divider in the transmitting frequency band. The power ratio may vary in the range of 1:1 to a maximum of 10:1. Thus, certain dimensions of the inputs and outputs A1 and A2, and of the septum S must be accounted for. In certain embodiments, outputs A1 and A2 have differing effective widths, and are symmetrical to each other. When symmetrical, outputs A1 and A2 may be located on the shared second center line M of FIG. 1. Symmetrical outputs may cause the signal conduction lengths between multiple power dividers and to the antenna elements AR1 . . . ARx to remain the same, and may also ensure that differing lengths do not additionally have to be compensated for with respect to phase position. In certain embodiments, the impedance ratio of the two outputs A1 and A2 does not exceed a maximum of 1:1.7. For example, for a rectax or ridge waveguide, impedance ratio of the two outputs A1 and A2 may be 1:1.5, In embodiments of the present disclosure, the maximum length of the septum S projecting into the signal conductor H does not exceed $\lambda/2$. The wavelength $\lambda$ may refer to the maximum wavelength in the receiving frequency band rx and the transmitting frequency ban tx. In embodiments of the present disclosure, the maximum width of the septum S may be indicated with a maximum of $\lambda/3$ in waveguide technology, for example. In embodiments of the present disclosure, in microstrip technology MS, for example, the maximum width of the septum S should not exceed 0.8 of the input conduction width. In embodiments of the present disclosure, the displacement of the septum S from the center line M should not exceed $\lambda/4$.

According to the present disclosure, array antennas for satellite communications applications can be optimized, wherein the receiving and transmitting frequency bands rx and tx may be in the Ka band or Ku-band. In the transmitting frequency band tx, the transmission characteristics can be set very precisely, while the antenna gain may remain at a maximum level in the receiving frequency band rx due to a symmetrical power combination.

The power divider network can be used jointly for the receiving and transmitting frequency ranges in an array antenna. Embodiments of the present disclosure may reduce the required number of power dividers in the antenna by half. Thus, the antenna can be implemented more compactly and with a lower weight. Additionally, costs for the antenna can be reduced.

What is claimed is:

1. A power divider having a signal frequency range, the power divider comprising:

a signal conductor comprising:

an input;

a first conductor section comprising a first width and a first output;

a second conductor section comprising a second width and a second output; and a septum extending into the signal conductor from a side of the signal conductor opposite the input, the septum being offset in relation to an axis extending from the center of the input and dividing the first and second conductor sections, wherein the septum has a length extending into the signal conductor not greater than half a wavelength, and the wavelength equals a maximum wavelength of the signal frequency range, wherein the signal frequency range includes a receiving frequency band and a transmitting frequency band;

wherein:

the first and second widths are different;

a width of the first output is equal to the first width;

a width of the second output is equal to the second width;

the receiving frequency band and the transmitting frequency band are in separate frequency bands; and a power divider ratio of the power of the first and second outputs in the receiving frequency band is smaller than a power divider ratio of the power of the first and second outputs in the transmitting frequency band.

2. The power divider according to claim 1, wherein the power divider is connected to a transceiver device by the input, and wherein the power divider is connected to antenna elements by the first and second outputs.

3. The power divider according to claim 1, wherein the first and second outputs have a shared axis of symmetry.

4. The power divider according to claim 1, wherein the signal conductor is a waveguide.

5. The power divider according to claim 1, wherein the signal conductor is a neutral conductor.

6. The power divider according to claim 1, wherein
the first output has a first impedance,
the second output has a second impedance, and
the septum is located nearer to the output having the greater impedance.

7. The power divider according to claim 1, wherein an impedance ratio of the first output to the second output equals a ratio substantially between 1:1.1 to 1:1.7.

8. The power divider according to claim 1, wherein the septum has a width not greater than one third of the wavelength.

9. The power divider according to claim 1, wherein the septum is offset from the axis by an amount not greater than one quarter of the wavelength.

10. The power divider according to claim 1, wherein the receiving frequency band and the transmitting frequency band are in a Ka band or Ku band.

11. An antenna comprising a plurality of antenna elements, wherein the plurality of antenna elements are connected to a transceiver device via at least one power divider according to claim 1.

12. The antenna according to claim 11, wherein a difference in power between a first output and a second output in the transmitting frequency band differs between neighboring power dividers.

13. A power divider for connecting an antenna element to a transceiver device, the power divider comprising:
a signal conductor comprising:
an input;
a first conductor section comprising a first width and a first output;
a second conductor section comprising a second width and a second output; and
a septum extending into the signal conductor from a side of the signal conductor opposite the input, wherein the septum is offset in relation to an axis extending from the center of the input and dividing the first and second conductor sections;
wherein:
the first and second widths are different;
a width of the first output is equal to the first width;
a width of the second output is equal to the second width;
the septum has a length extending into the signal conductor not greater than half a wavelength;
the wavelength equals a maximum wavelength of a receiving frequency band and a transmitting frequency band;
the receiving frequency band and the transmitting frequency band are in separate frequency bands; and
a power divider ratio of the power of the first and second outputs in the receiving frequency band is smaller than a power divider ratio of the power of the first and second outputs in the transmitting frequency band.

14. The power divider according to claim 13, wherein the first and second outputs have a shared axis of symmetry.

15. The power divider according to claim 13, wherein the signal conductor is a waveguide.

16. The power divider according to claim 13, wherein the signal conductor is a neutral conductor.

17. The power divider according to claim 13, wherein:
the first output has a first impedance,
the second output has a second impedance, and
the septum is located nearer to the output having the greater impedance.

18. The power divider according to claim 13, wherein an impedance ratio of the first output to the second output equals a ratio substantially between 1:1.1 to 1:1.7.

19. The power divider according to claim 13, wherein the septum has a width not greater than one third of the wavelength.

20. The power divider according to claim 13, wherein the septum is offset from the axis by an amount not greater than one quarter of the wavelength.

* * * * *